US005996850A

United States Patent [19]

Morali et al.

[11] Patent Number: 5,996,850

[45] Date of Patent: Dec. 7, 1999

[54] PACKAGE FOR DISPENSING FLOWABLE COSMETICS

[75] Inventors: Mauricio Morali; Antonio Leon de la Barra, both of Cuernavaca, Mexico

[73] Assignee: Chesebrough-Pond's USA Co, Greenwich, Conn.

[21] Appl. No.: 09/005,159

[22] Filed: Jan. 9, 1998

Related U.S. Application Data

[60] Provisional application No. 60/067,551, Dec. 4, 1997.

[51] Int. Cl.[6] ..... B67D 5/64

[52] U.S. Cl. ..... 222/173; 222/179.5; 222/184; 222/185.1; 222/212; 222/545; 222/546; 222/575

[58] Field of Search ..... 222/173, 179.5, 222/184, 185.1, 212, 545, 546, 575; 401/174, 175

[56] References Cited

U.S. PATENT DOCUMENTS

| | | | |
|---|---|---|---|
| 2,103,111 | 12/1937 | Ekdahl | 222/545 |
| 3,128,923 | 4/1964 | Gabler . | |
| 3,236,417 | 2/1966 | Linton | 222/179.5 |
| 3,342,379 | 9/1967 | Foley | 222/546 |
| 3,708,083 | 1/1973 | Gronemeyer et al. . | |
| 5,000,356 | 3/1991 | Johnson et al. | 401/175 |

FOREIGN PATENT DOCUMENTS

| | | |
|---|---|---|
| 0 082 777 | 6/1983 | European Pat. Off. . |
| 9 256 923 | 2/1988 | European Pat. Off. . |
| 86 00639 | 1/1986 | France . |
| 84 15 186 | 5/1984 | Germany . |
| 87 10 748 | 8/1987 | Germany . |
| 94/29185 | 12/1994 | WIPO . |

*Primary Examiner*—David J. Walczak
*Assistant Examiner*—Timothy L. Maust
*Attorney, Agent, or Firm*—Milton L. Honig

[57] ABSTRACT

A package for dispensing a flowable substance is provided which includes a container, a closure and a cap. The container on a closed end is sufficiently rounded to render that end incapable of standing upright. A second end of the container has a round opening for dispensing the flowable substance. The closure is positioned across the second end and includes an oval top wall with opposite exterior and interior surfaces, a skirt surrounding the top wall and at least two separate apertures for fluidly communicating with the opening of the container. The cap is seatable over the closure and includes a roof with an inner surface and a flat outer surface, an apron surrounding the roof and a set of plugs projecting downwardly from the inner surface of the roof. The plugs are equivalent in number and shape to the apertures and seatable therewithin to prevent egress of flowable substance from the container.

8 Claims, 2 Drawing Sheets

PACKAGE FOR DISPENSING FLOWABLE COSMETICS

This application claims benefit of provisional application 60/067,155, filed Dec. 4, 1997.

BACKGROUND OF THE INVENTION

1. Field of the Invention

The invention concerns a package for dispensing a flowable substance, particularly a cosmetic such as a cream or gel antiperspirant/deodorant.

2. The Related Art

Antiperspirant and deodorant creams and gels are delivered in several types of packaging. Most are of the upright variety where the dispensing end is oriented away from a surface upon which the product rests. U.S. Pat. No. 5,000,356 (Johnson et al.) describes a commercially popular antiperspirant product delivered in an upright package. Product is propelled toward the dispensing end by means of a screw-threaded shaft which elevates a platform or piston. The shaft is actuated by turning a knob. Systems of this type are primed for immediate dispensing. Unfortunately, the propelling mechanism is not only expensive but sometimes can malfunction as a result of its multiple moving parts.

The market place has also seen dispensing end oriented downward packages which rest on their cap. These systems rely upon gravity to ensure immediate availability of product. Examples of such products are "Alliance De Faberge" and "Nivea" deodorant creams. These represent improvements in the sense of being simplified tubes. However, application of antiperspirant/deodorants is a messy task. The closures of these products are poorly designed for even delivery to the underarm.

Accordingly, it is an object of the present invention to provide a delivery system, especially for underarm products, which provides immediate dispensing of the product.

Another object of the present invention is to provide a delivery system, especially for underarm products, which allows a more even application to the skin.

SUMMARY OF THE INVENTION

A package for dispensing a flowable substance is provided which includes:

(i) a container with opposite first and second ends, the first end being closed and sufficiently rounded to render the container incapable of standing upright on the first end, the second end having an opening defined by a mouth for dispensing the flowable substance;

(ii) a closure positioned across the second end, the closure including an oval top wall with opposite exterior and interior surfaces, a skirt surrounding the top wall and at least two separate apertures formed in the top wall fluidly communicating with the opening of the container; and (iii) a cap seatable over the closure, the cap including a roof with an inner surface and a flat outer surface, an apron surrounding the roof and a set of plugs projecting downwardly from the inner surface of the roof, the plugs being equivalent in number to the apertures and seatable therewithin to prevent egress of flowable substance from the container.

In a preferred embodiment the container along the first rounded end is relatively rigid while a middle area of the container is relatively flexible to allow squeezing of the walls. Application of finger pressure against the flexible walls achieves some control over amount and rate of product expression. Polypropylene and polyethylene are useful plastics for constructing the package.

The closure on an interior surface includes an outer and inner round concentrically arranged downwardly projecting set of walls. The mouth which defines the opening of the container is preferably round. The mouth may sealingly be fitted between the outer and inner walls. Closure and container are thereby locked together.

All the apertures for dispensing flowable substance are preferably found on an area of the closure within bounds of the inner round wall. For best and uniform product dispersible, the apertures are elongate slits parallel to one another. In particular, the apertures in the preferred embodiment are S-shaped, being symmetrical and equidistantly spaced one from another. Optimally the apertures are three in number but can range from as few as two to as many as several dozen.

The closure may further include recesses on opposite sides of the skirt. The cap may include a nib on opposite sides of an inner surface of the apron. The nibs are engageable within the respective recesses to lock the cap into place over the closure.

Packages of the present invention do not require and are not fitted with any moving parts such as platforms or elevating screw shafts to force product from a closed to an open end of the container. Instead, reliance is placed solely upon the effects of gravity and/or hand squeezing pressure on the container walls to transport product out of the container.

DETAILED DESCRIPTION OF THE DRAWINGS

Further advantages, features and objects of the present invention will become more readily apparent through the accompanying drawing in which.

DETAILED DESCRIPTION

Figure 1:
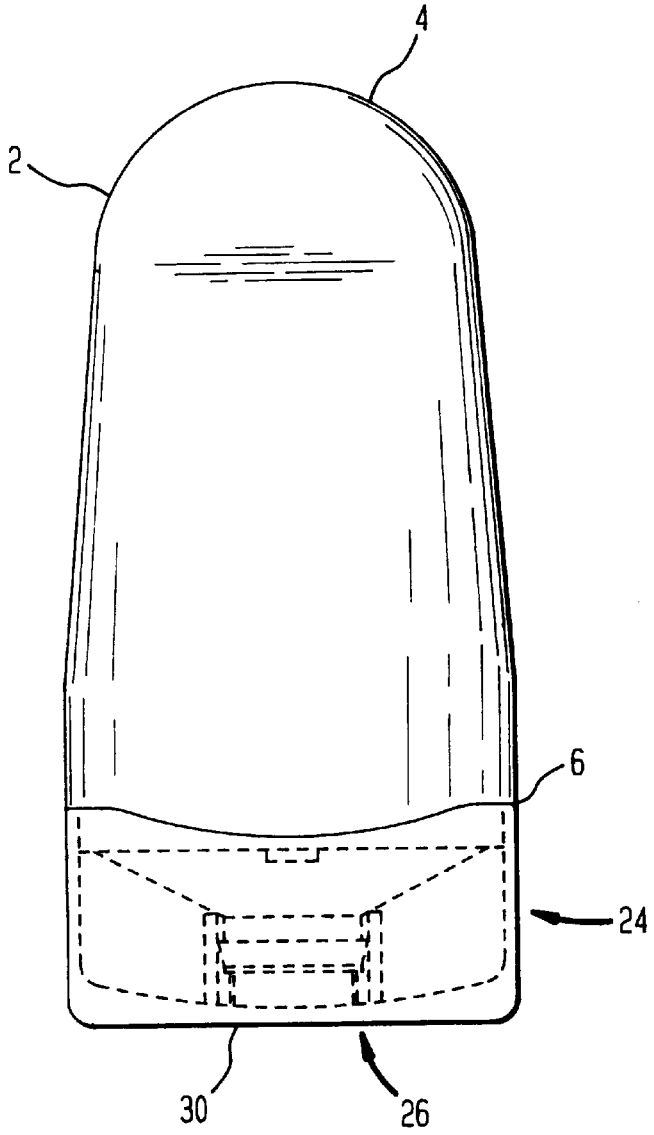
FIG. 1 is a front elevational view of the package according to the present invention.
Figure 2:
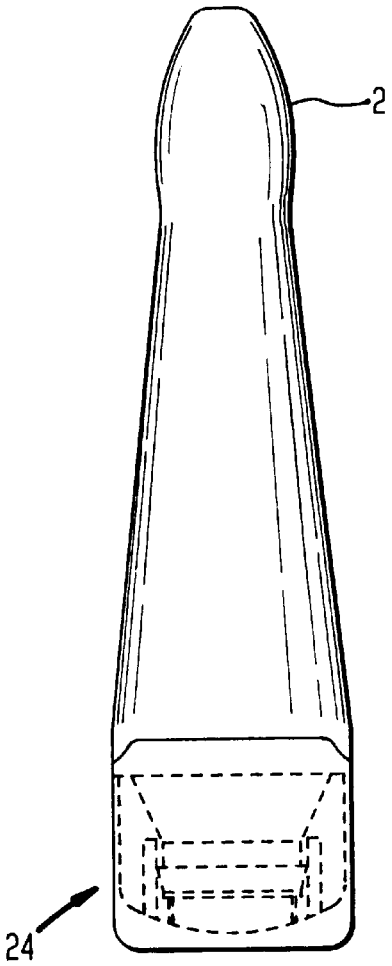
FIG. 2 is a side elevational view of the package shown in FIG. 1.
Figure 3:
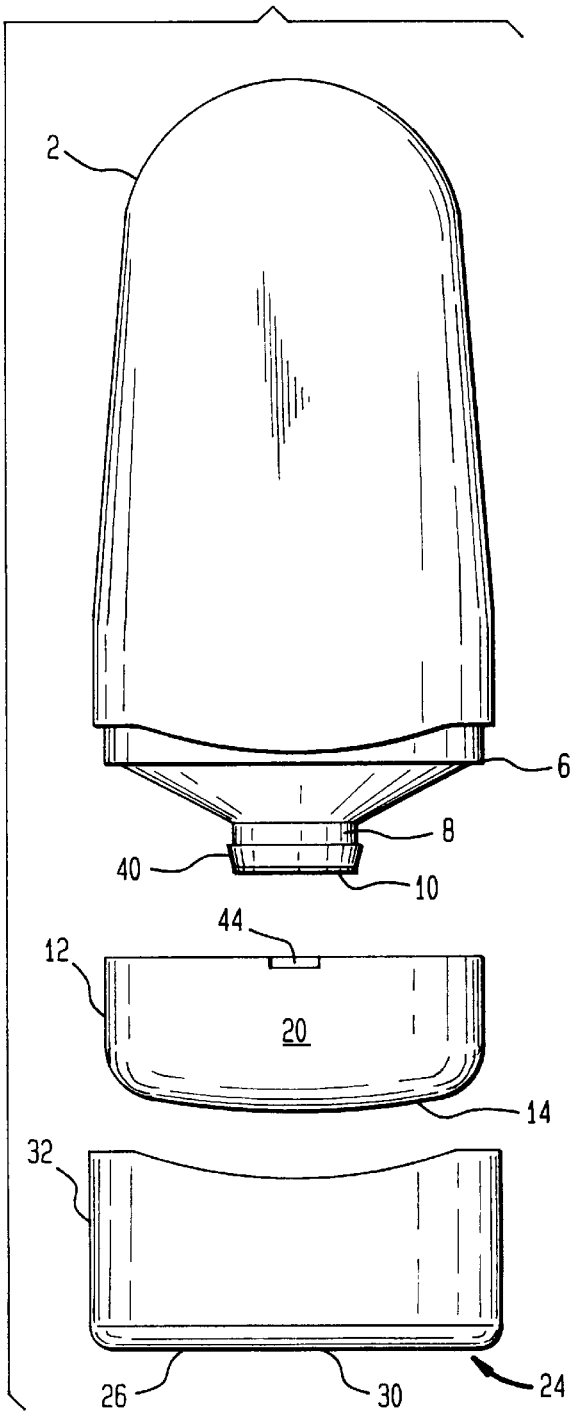
FIG. 3 is an exploded view of the package shown in FIG. 1.

Now there has been developed a dispensing end downward type package which delivers a product in a uniform manner over a wider dispensing area than previously achievable. FIGS. 1, 2 and 3 illustrate the new package which includes a container 2 with opposite first and second ends 4, 6. The first end is closed and sufficiently rounded to render the container incapable of standing upright on the first end. The second end has an opening 8 defined by a mouth 10 for dispensing flowable substances stored within the container.

Figure 5:
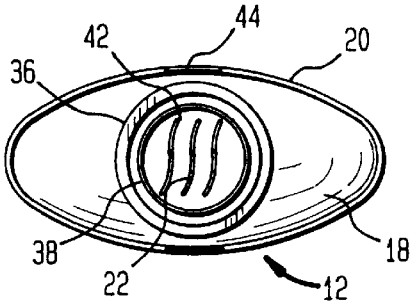
FIG. 5 is a bottom plan view of the closure shown in FIG. 3.

The package shown in FIGS. 3 and 5 further includes a closure 12 positioned across the second end 6. The closure includes an oval top wall 14 with opposite exterior and interior surfaces 16, 18, a skirt 20 surrounding the top wall and three separate apertures 22 formed in the top wall fluidly communicating with opening 8 of the container.

Figure 6:
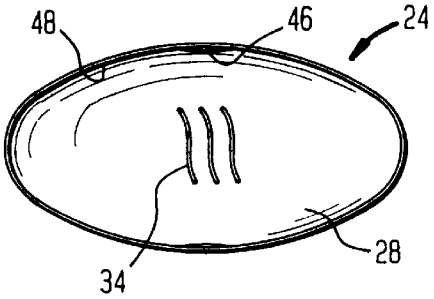
FIG. 6 is a bottom plan view of the cap shown in FIG. 3.
Figure 7:
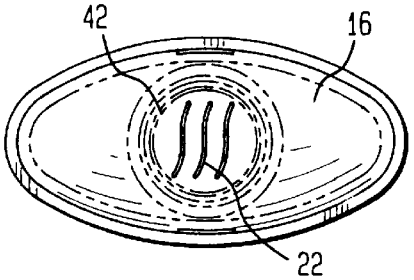
FIG. 7 is a top plan view of the closure mounted onto the container shown in FIG. 3.

FIGS. 3 and 6 illustrate a cap 24 seatable over the closure. The cap includes a roof 26 with an inner surface 28 and a flat outer surface 30. An apron 32 surrounds the roof. Three plugs 34 project downwardly from the inner surface 28 of the roof. The plugs are congruent to the apertures and snugly fit therewithin to prevent egress of flowable substances from the container.

Figure 4:
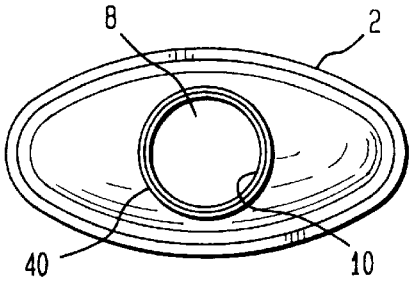
FIG. 4 is a top plan view of the container with closure and cap removed.

FIG. 5 illustrates the interior surface 18 of the closure further including a round outer and inner downwardly projecting set of walls 36, 38. The mouth 10 of the container, best shown in FIG. 4, is sealingly press fitted between the outer and inner walls. A tapered ledge 40 circumferentially surrounds mouth 10 and serves as a detent for locking the opening 8 between the walls 36, 38. All three of the apertures 22 are formed on an area 42 of the closure within bounds of the inner round wall. These apertures are all S-shaped, symmetrical and parallel to one another.

Along a lower edge of the closure are a pair of recesses 44 positioned on opposite sides of the skirt. FIG. 6 illustrates the cap containing nibs 46 on opposite sides of an inner surface 48 of the apron. These nibs are engageable within respective recesses 44 to lock the cap into place over the closure.

The foregoing description and drawing illustrate selected embodiments of the present invention and in light thereof various modifications will be suggested to one skilled in the art all of which are within the spirit and purview of this invention.

What is claimed is:

1. A package for dispensing a flowable substance comprising:

(i) a container with opposite first and second ends, the first end being closed and sufficiently rounded to render the container incapable of standing upright on the first end, the second end having an opening defined by a round mouth wall for dispensing the flowable substance;

(ii) a closure positioned across the second end, the closure including an oval top wall with opposite exterior and interior surfaces, a skirt surrounding the top wall and at least two separate apertures formed in the top wall fluidly communicating with the opening of the container, the interior surface of the closure further comprising an outer and inner concentrically arranged downwardly projecting set of walls, the mouth wall of the container sealingly fitting between the outer and inner walls; and (iii) a cap seatable over the closure, the cap including a roof with an inner surface and a flat outer surface, an apron surrounding the roof and a set of plugs projecting downwardly from the inner surface of the roof, the plugs being equivalent in number to the apertures and seatable therewithin to prevent egress of flowable substance from the container.

2. The package according to claim 1 wherein all the apertures are formed on an area of the closure within bounds of the inner concentrically arranged downwardly projecting wall.

3. The package according to claim 1 wherein the apertures are S-shaped.

4. The package according to claim 1 wherein the apertures are all elongate and parallel to one another.

5. The package according to claim 4 wherein the apertures are three in number, identical in size and S-shaped.

6. The package according to claim 1 wherein the closure further comprises a recess on opposite sides of the skirt.

7. The package according to claim 6 wherein the cap further comprises a nib on opposite sides of an inner surface of the apron, the nib being engageable within respective recesses to lock cap into place over the closure.

8. A package for dispensing a flowable substance comprising:

(i) a container with opposite first and second ends, the first end being closed and sufficiently rounded to render the container incapable of standing upright on the first end, the second end having an opening defined by a mouth wall for dispensing the flowable substance, the container along the first and second ends being relatively rigid while a middle area of the container being relatively flexible to allow squeezing of walls forming the container;

(ii) a closure positioned across the second end, the closure including an oval top wall with opposite exterior and interior surfaces, a skirt surrounding the top wall and at least two separate apertures formed in the top wall fluidly communicating with the opening of the container; and (iii) a cap seatable over the closure, the cap including a roof with an inner surface and a flat outer surface, an apron surrounding the roof and a set of plugs projecting downwardly from the inner surface of the roof, the plugs being equivalent in number to the apertures and seatable therewithin to prevent egress of flowable substance from the container.

* * * * *